US006490886B1

(12) United States Patent
Steinhauer et al.

(10) Patent No.: US 6,490,886 B1
(45) Date of Patent: Dec. 10, 2002

(54) INTERCHANGEABLE RING

(75) Inventors: David Steinhauer, North Easton; Byron Sandoval, Revere, both of MA (US)

(73) Assignee: Goldman Kolber, Inc., Norwood, MA (US)

( * ) Notice: Subject to any disclaimer, the term of this patent is extended or adjusted under 35 U.S.C. 154(b) by 0 days.

(21) Appl. No.: 09/583,265

(22) Filed: May 31, 2000

(51) Int. Cl.[7] ..... A44C 19/00

(52) U.S. Cl. ..... 63/15; 63/15.4; 63/26; 63/29.1

(58) Field of Search ..... 63/15, 15.1, 15.7, 63/26, 29.1

(56) References Cited

U.S. PATENT DOCUMENTS 2,430,508 A * 11/1947 Holl ..... 63/15
4,794,766 A * 1/1989 Schunk et al. ..... 63/15
5,069,045 A * 12/1991 Mejias ..... 63/3
5,727,399 A * 3/1998 Bergagnini ..... 63/15.4

* cited by examiner

*Primary Examiner*—Jack Lavinder
*Assistant Examiner*—Andrea Chop
(74) *Attorney, Agent, or Firm*—Samuels, Gauthier & Stevens

(57) ABSTRACT

A finger ring comprising a generally circular band defining a finger receiving opening. The band has a radially outwardly open window. A jewelry piece is removably received in a displayed position within the window. A pair of levers is rotatably supported on the band on opposite sides of the window. The levers have inner and outer segments and are rotatably adjustable between open and closed positions. In the open position the inner segments protrude into the finger receiving opening and the outer segments are removed from the window to thereby accommodate insertion and removal of the jewelry piece into and from the displayed position. In the closed positions the inner segments are removed from the finger receiving opening and the outer segments extend into the window to mechanically engage and retain the jewelry piece in the displayed position.

6 Claims, 3 Drawing Sheets

INTERCHANGEABLE RING

BACKGROUND OF THE INVENTION

1. Field of the Invention

This invention relates generally to articles of jewelry, and is concerned in particular with a finger ring having interchangeable jewelry pieces.

2. Description of the Prior Art

Finger rings having detachable or interchangeable jewelry pieces are known, as shown for example by U.S. Pat. No. 1,182,534 (Driggott); U.S. Pat. No. 1,971,265 (King); U.S. Pat. No. 3,307,375 (Estrin et al.); U.S. Pat. No. 4,794,766 (Schunk et al.); and U.S. Pat. No. 5,996,374 (Bardisbanyan). These suffer from various drawbacks, including unsightly and/or unduly complicated retaining mechanisms, poor retention reliability, etc.

A major objective of the present invention is the provision of a finger ring with a simple yet reliable mechanism for securely retaining interchangeable jewelry pieces in place in displayed positions on the ring band.

A companion objective of the present invention is the provision of an improved retaining mechanism which does not detract from the overall appearance of the ring, and which cannot be inadvertently disengaged while the ring is being worn.

SUMMARY OF THE INVENTION

In accordance with the present invention, a finger ring comprises a generally circular band defining a finger receiving opening and having a radially outwardly open window. A jewelry piece is removably received in a displayed position within the window. A pair of levers are rotatably supported on the band on opposite sides of the window. The levers have inner and outer segments and are rotatably adjustable between open positions at which their inner segments protrude into the finger receiving opening and their outer segments are removed from the window to thereby accommodate insertion and removal of the jewelry piece into and from its displayed position, and closed positions at which the inner segments are removed from the finger receiving opening and the outer segments mechanically engage and retain the jewelry piece in its displayed position.

These and other features, advantages and objectives of the present invention will now be described in greater detail with reference to the accompanying drawings wherein:

DETAILED DESCRIPTION OF PREFERRED EMBODIMENT

Figure 1:
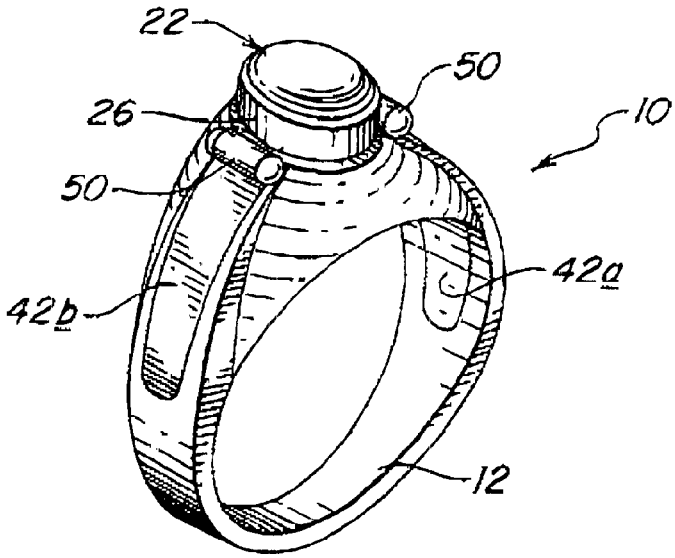
FIG. 1 is a perspective view of a finger ring in accordance with the present invention.

A finger ring in accordance with the present invention is generally depicted at 10 as comprising a generally circular band 12 defining a finger receiving opening 14. The band 12 is provided with a radially outwardly open window 16 surrounded by a first ledge 18 recessed as at 20. A jewelry piece 22 is configured and dimensioned to be received in a displayed position within the window 16. The jewelry piece may include a precious or semiprecious stone 24 or the like set within a metal bezel 26 having a peripheral rim 28 adapted to be seated on the first ledge 18 when the jewelry piece is in its displayed position within the window 16. The jewelry piece is additionally provided with a skirt 30 depending beneath the rim 28. Oppositely disposed first openings 32 are provided in the skirt 30.

The band 12 is further provided with second openings 34 underlying the first ledge 18 on opposite sides of the window 16. The second openings 34 are partially bordered by inwardly projecting second ledges 36. The band 12 also includes internal recesses 38 opening radially into the finger receiving opening 14, and external outwardly facing recesses 40.

A pair of levers 42 are rotatably connected as at 44 to the band 12 on opposite sides of the window 16. The levers have inner and outer segments 42*a*, 42*b*. The outer lever segments are provided with inwardly projecting first and second spurs 46, 48, and external bosses 50.

Figure 2:
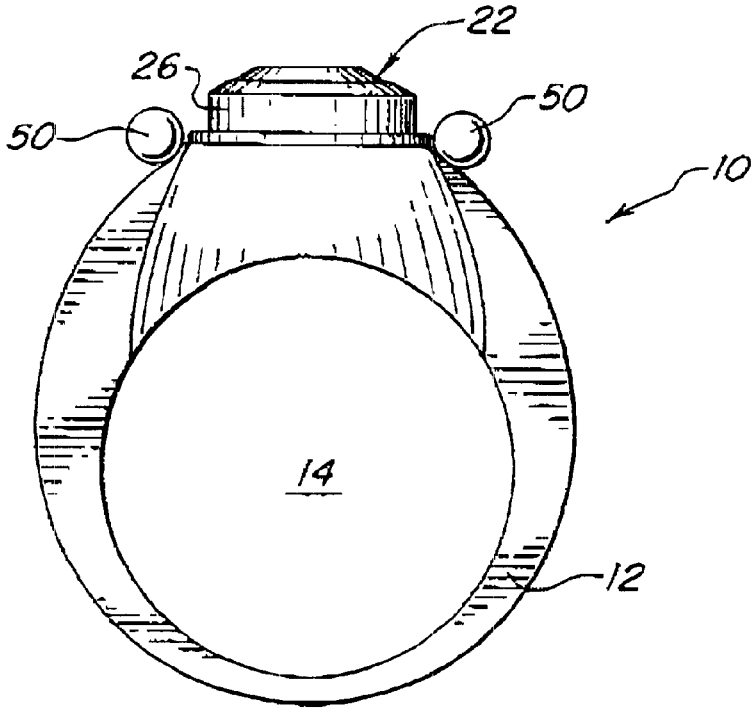
FIG. 2 is a side view of the finger ring.
Figure 3:
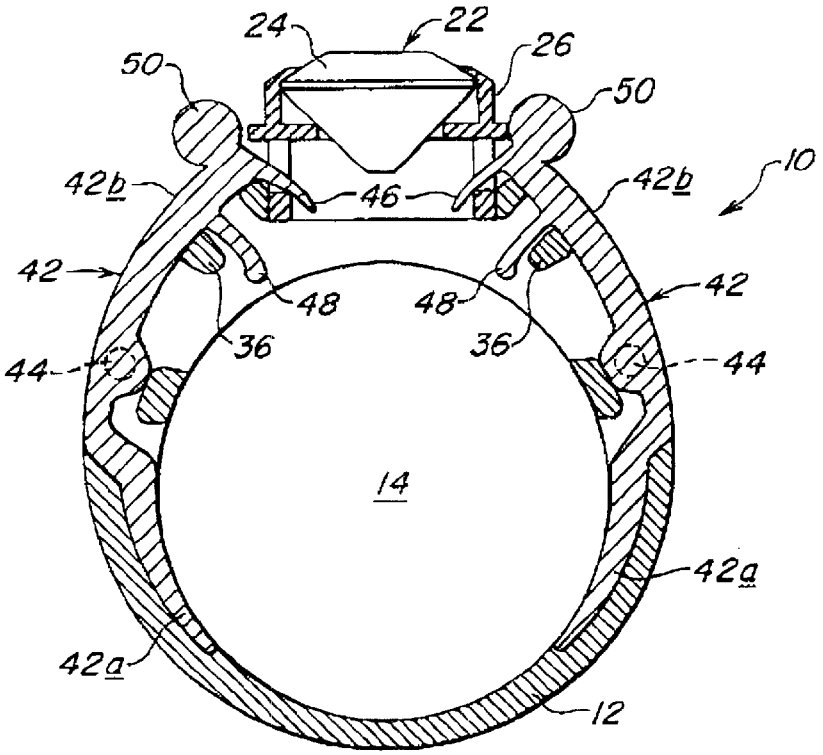
FIG. 3 is a vertical sectional view taken through the finger ring.
Figure 4:
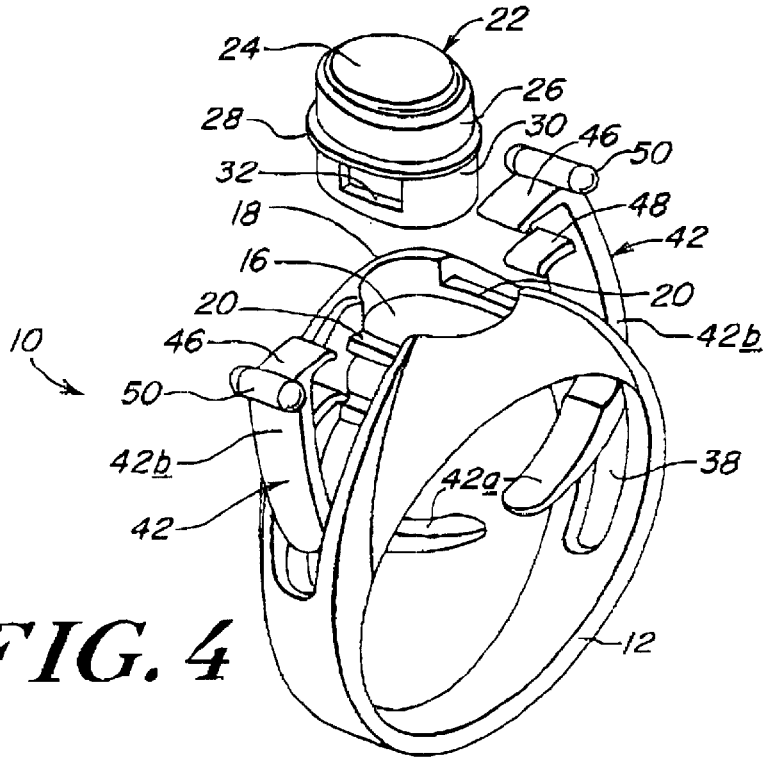
FIG. 4 is an exploded perspective view of the ring components showing the jewelry piece removed from its displayed position.
Figure 5:
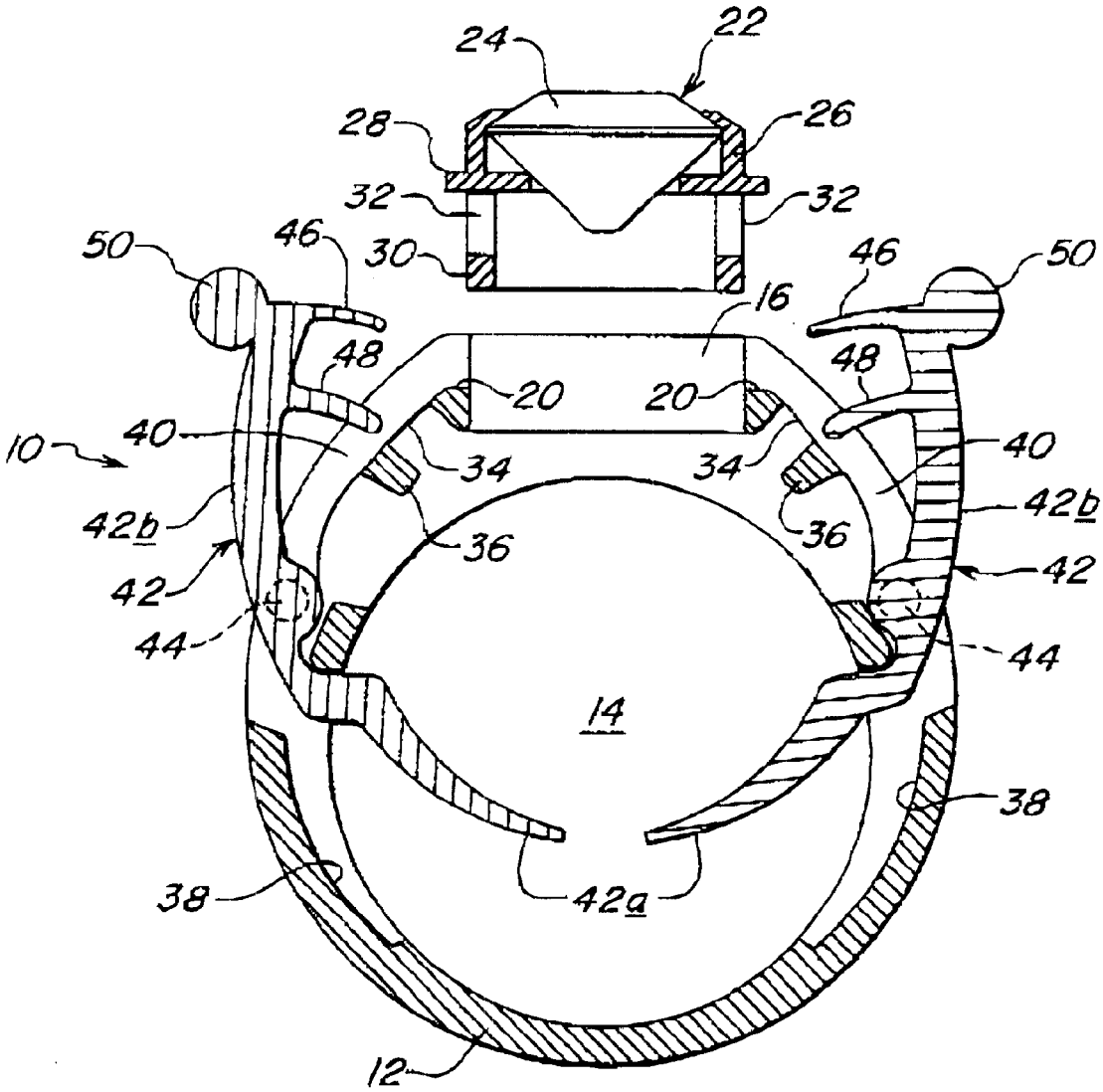
FIG. 5 is a sectional view taken through the exploded components shown in FIG. 4.

The levers 42 are rotatably adjustable between closed positions as shown in FIGS. 1–3, and open positions as shown in FIGS. 4 and 5. When the levers are in their open positions, the inner segments 42*a* protrude into the finger receiving opening 14 and the outer segments 42*b* are inclined away from the window 16 to thereby accommodate insertion and removal of the jewelry piece 22, or an interchangeable replacement piece (not shown) into and from the window 16.

When the levers 42 are in the closed positions, the first prongs 46 of the outer lever segments 42*b* overlap the first ledge 18 in recesses 20 and are received in the first openings 32 of the jewelry piece skirt 30, thereby securely retaining the jewelry piece in its displayed position within window 16. At the same time, the second prongs 48 are received in the second openings 34 where they overlap and coact in an interference fit with the second ledges 36 to releasably retain the levers in their closed positions. The upper lever segments 42*b* are received in the exterior band recesses 40, and the inner lever segments 42*a* are received in the interior band recesses 38.

The net result is a clean uncluttered outer appearance. When the ring is received on a wearer's finger, opening 14 is completely filled, thus preventing the inner lever segments 42*a* from rotating to the open position. This effectively rules out any inadvertent dislodgement of the jewelry piece from its displayed position.

We claim:

1. A finger ring comprising:

a generally circular band defining a finger receiving opening, said band having a radially outwardly open window;

a jewelry piece removably received in a displayed position within said window;

a pair of levers rotatably supported on said band on opposite sides of said window, said levers having inner and outer segments and being rotatably adjustable between open positions at which said inner segments protrude into said finger receiving opening and said outer segments are removed from said window to thereby accommodate insertion and removal of said jewelry piece into and from said displayed position, and closed positions at which said inner segments are removed from said finger receiving opening and said outer segments extend into said window to mechanically engage and retain said jewelry piece in said displayed position.

2. The finger ring of claim 1 wherein said window is surrounded by a first ledge, and said jewelry piece is provided with a peripheral rim seated on said first ledge when said jewelry piece is received in said window.

3. The finger ring of claim 2 wherein said jewelry piece is further provided with a skirt depending beneath said rim, said skirt having first openings, and wherein the outer segments of said levers are provided with first spurs configured and arranged to enter said first openings when said levers are in said closed positions.

4. The finger ring of claim 3 wherein said first spurs overlap said first ledge when said levers are in said closed positions.

5. The finger ring of claim 3 or 4 wherein said band is provided with second openings on opposite sides of said window, said second openings being partially bordered by second ledges underlying said first ledge, and wherein the outer segments of said levers have second spurs configured and arranged to enter said second openings and to coact in an interference fit with said second ledges to releasably retain said levers in said closed positions.

6. The finger ring of claim 1 wherein said band is provided with inner recesses opening radially into said finger receiving opening and external recesses facing outwardly of said band, and wherein the inner and outer segments of said levers are received, respectively, in said inner and external recesses when said levers are in said closed positions.

* * * * *